United States Patent [19]

Sheehan et al.

[11] Patent Number: 4,536,098

[45] Date of Patent: Aug. 20, 1985

[54] SELF-REGULATING RIBBON RE-INKING DEVICE

[75] Inventors: Bernard P. Sheehan, Cincinnati; Volker Werwick, Miamisburg, both of Ohio

[73] Assignee: NCR Corporation, Dayton, Ohio

[21] Appl. No.: 652,157

[22] Filed: Sep. 18, 1984

Related U.S. Application Data

[63] Continuation of Ser. No. 528,867, Sep. 2, 1983, abandoned, which is a continuation-in-part of Ser. No. 374,823, May 4, 1982, abandoned.

[51] Int. Cl.[3] ..... B41J 32/02

[52] U.S. Cl. ..... 400/196.1; 400/202; 400/202.4; 400/208

[58] Field of Search ..... 400/194, 195, 196, 196.1, 400/197, 198, 199, 200, 201, 202, 202.1, 202.2, 202.3, 202.4, 207, 208, 208.1

[56] References Cited

U.S. PATENT DOCUMENTS

| | | | |
|---|---|---|---|
| 1,086,852 | 2/1914 | Post | 400/194 X |
| 2,074,971 | 3/1937 | Pelton | 400/199 |
| 4,091,914 | 5/1978 | Stipanuk | 400/196.1 |
| 4,247,209 | 1/1981 | Carlson et al. | 400/195 |

FOREIGN PATENT DOCUMENTS

| | | | |
|---|---|---|---|
| 0019649 | 12/1980 | European Pat. Off. | 400/196.1 |
| 156810 | 5/1904 | Fed. Rep. of Germany | 400/202 |
| 2550305 | 5/1977 | Fed. Rep. of Germany | 400/196.1 |
| 2033872 | 5/1980 | United Kingdom | 400/202.4 |

*Primary Examiner*—Edgar S. Burr
*Assistant Examiner*—Charles A. Pearson
*Attorney, Agent, or Firm*—Wilbert Hawk, Jr.; Albert L. Sessler, Jr.; George J. Muckenthaler

[57] ABSTRACT

A ribbon cartridge has a ribbon re-inking mechanism which is made up of a porous rubber or elastomer ink roll journaled on a fixed shaft and in contact with an ink transfer roll journaled on a pivotable member and rockable against the ink roll. The ink ribbon provides the force necessary to urge the transfer roll in contact with the ink roll and also to drive the rolls in normal operation. A modified arrangement includes a balancing roll to enable proper operation of the re-inking mechanism in different orientation and movement of the ribbon cartridge and to increase re-inking sensitivity.

4 Claims, 14 Drawing Figures

FIG. 4
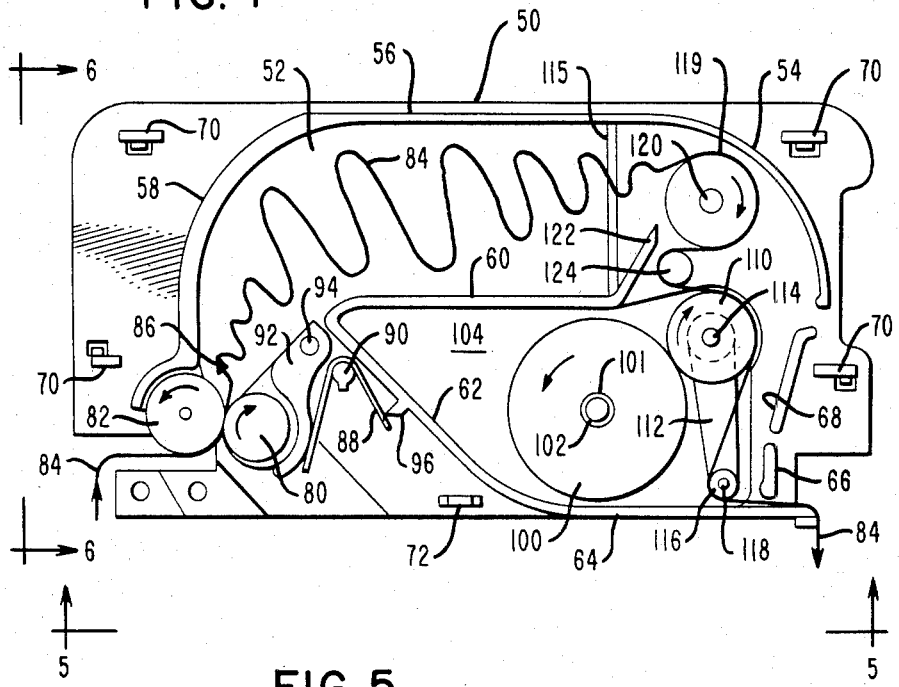
FIG. 5
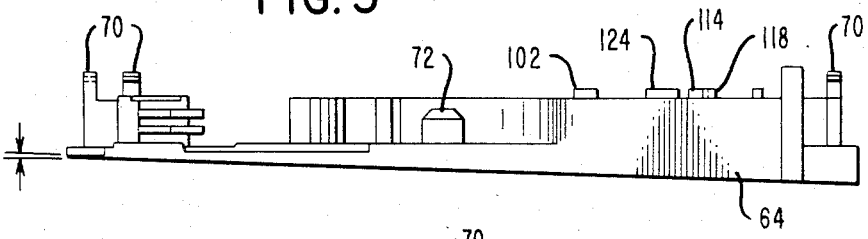
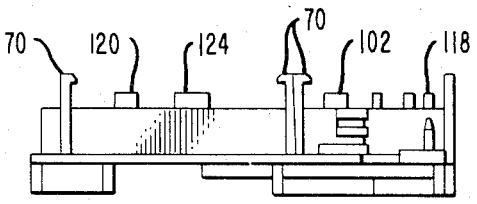
FIG. 6
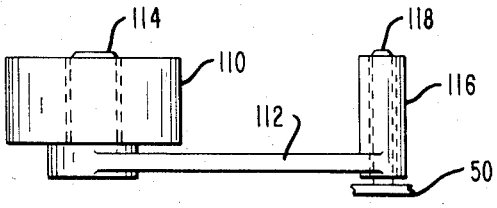
FIG. 7

FIG. 12
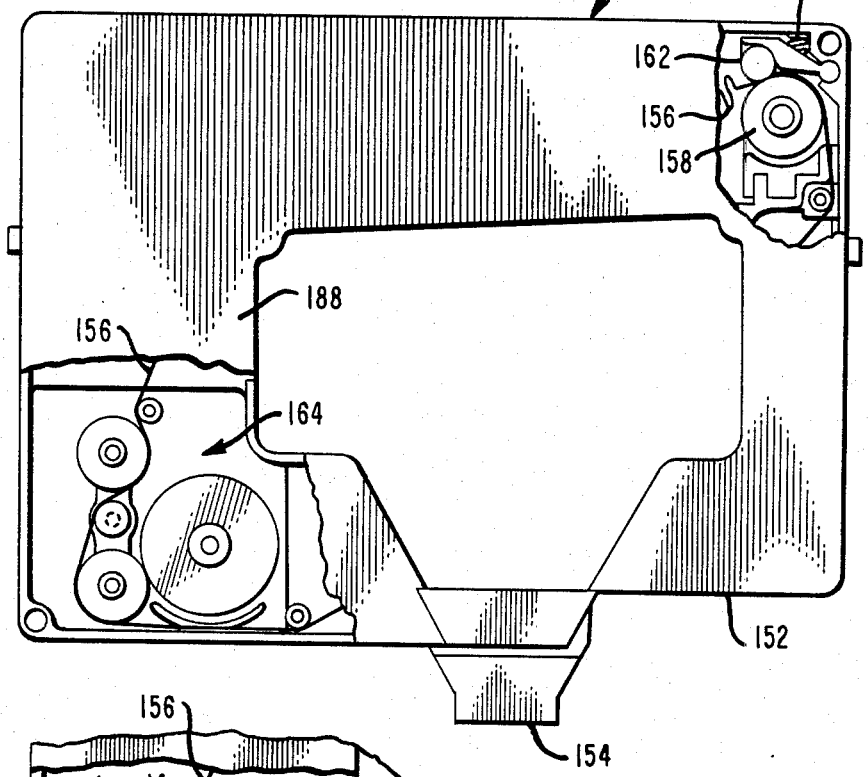
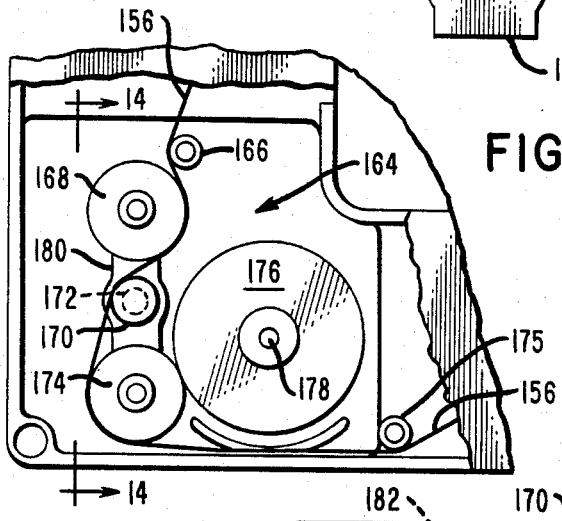
FIG. 13
FIG. 14
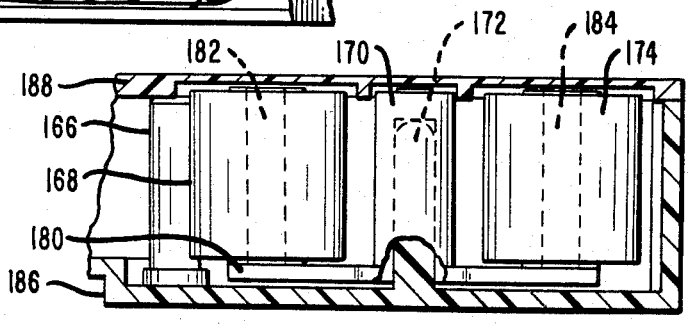

SELF-REGULATING RIBBON RE-INKING DEVICE

CROSS REFERENCE TO RELATED APPLICATION

This is a continuation of co-pending application Ser. No. 528,867 filed on Sept. 2, 1983, now abandoned, which is a continuation-in-part of application Ser. No. 374,823, filed May 4, 1982, now abandoned.

BACKGROUND OF THE INVENTION

In the field of ink ribbons for printers, a ribbon supply spool and a ribbon take-up spool generally have been provided on opposite sides of a typing or printing station, together with means for reversing the direction of travel of the ribbon for repeated use thereof in an arrangement for the purpose of obtaining longer ribbon life. Also, the ink ribbon has been made to travel along a line of printing wherein the spools are positioned beyond the ends of the printing line and the ribbon is caused to travel at an angle relative to the print line to utilize a greater portion of the ribbon width. However, in the case of certain high speed printers, a ribbon substantially as wide as the line of printing may be used and caused to travel in a direction normal to the print line and along with the record media. Additionally, it has been common to provide ink carrying or container means operably associated with the ribbon for maintaining or replenishing a supply of ink therein for proper and extended life printing operation.

In present day printers, it is also common practice to provide and use a ribbon cassette carrying an endless ribbon which is caused to be driven past the printing station, and wherein the printing ribbon is either a pre-inked and disposable ribbon or a ribbon which is to be continuously or frequently re-inked during the printing operation. The ribbon cassette itself may be of the stuffing-box type wherein the ribbon is contained within the cassette in random manner and such ribbon is unfolded at the cassette exit and caused to be driven past the printing station and then guided back into the cassette to be folded again in random manner therein.

Additionally, a ribbon may be utilized in a mobius loop configuration within the cassette and the ribbon may be in substantially continuous contact with an inking core or like manner, or the ribbon may have a plurality of coils thereof around a central core for controlled inking or re-inking of the ribbon.

Representative documentation relating to ribbon cassettes or cartridges and to inking or re-inking the ribbon therein includes U.S. Pat. No. 3,831,731, issued to R. H. Mack et al. on Aug. 27, 1974, which discloses a ribbon cartridge having tensioning means, a print wheel and a friction feed roller along with porous re-inking means and wherein the ribbon tensioning means comprises a plurality of ridge-like deformations.

U.S. Pat. No. 3,887,056, issued to J. H. Lehmann on June 3, 1975, discloses a ribbon cartridge having adjustable tensioning means and a plurality of pre-inked porous foam rollers with one of such rollers being urged by spring means into frictional contact against the other rollers for re-inking the ribbon.

U.S. Pat. No. 4,046,247, issued to R. E. LaSpesa et al. on Sept. 6, 1977, shows a ribbon cartridge which has an ink roll pivotally mounted and spring urged into frictional contact against a transfer coil for re-inking the ribbon.

U.S. Pat. No. 4,071,133, issued to H. Scherrer et al. on Jan. 31, 1978, discloses a ribbon cassette with an ink cylinder having a wick disposed in contact with a transfer roll for re-inking the ribbon.

U.S. Pat. No. 4,091,914, issued to A. D. Stipanuk on May 30, 1978, discloses a ribbon cassette having a source of marking fluid adjacent the ribbon and a wear-actuated device to cause delayed contact of marking fluid with the ribbon.

And, U.S. Pat. No. 4,175,877, issued to J. E. Randolph on Nov. 27, 1979, shows a ribbon cartridge having a sponge roller urged by spring means into contact with a transfer roller for re-inking the ribbon.

SUMMARY OF THE INVENTION

The present invention relates to ribbon cassettes, and more particularly to means for inking or re-inking the ribbon therein for the purpose of extending the life of the ribbon and to maintain the ribbon in a properly inked condition at all times.

An initial approach in the process for re-inking the ribbon was applicants' use of a re-inking canister having a wick disposed in contact with the ribbon and, in certain areas, similar to the arrangement disclosed in the above mentioned Scherrer et al. patent. The structure provided for re-inking the ribbon by direct contact of the wick with the ribbon rather than through an ink transfer roller.

Another approach of applicants was to use an ink saturated porous rubber roll mounted on a pivoted carriage and spring-urged into contact with an ink transfer roll, and also to use a ribbon tensioner to provide the required drive tension for the two associated rolls.

A third method of applicants used the ink saturated porous rubber roll mounted on a pivoted carriage and spring urged into contact with an ink transfer roll in the manner as mentioned just above. Further, a plurality of ribbon guide posts, disposed within the cassette, served to increase the ribbon wrap around the transfer roll to improve drive forces thereto and also to increase the ribbon tension.

A final approach for re-inking the ribbon and for overcoming certain problems of the prior concepts is disclosed in the structure and function of the present invention. A re-inking mechanism, which is small in size and insensitive to orientation, includes a porous rubber ink roll journaled on a fixed location or position shaft and operably associated with an adjacent ink transfer roll carried and journaled on a pivotable or rockable carriage. The ribbon is wrapped partially around the ink transfer roll by means of a guide positioned with respect to the transfer roll to provide proper drive tension or force to the transfer roll and also to the ink roll.

The pivoting of the transfer roll relative to and into pressure contact with the ink roll utilizes the ribbon itself to maintain such contact. As the ink in the ribbon is used or depleted therefrom, the ribbon tension increases by reason of the drying condition, which increased tension, in turn, causes the ribbon to urge the transfer roll against the ink roll with a greater force and thereby cause more or faster transfer of ink from the ink roll to the transfer roll. As the transfer roll becomes more saturated with ink, the ribbon tension decreases by reason of the ink wetting condition thereof and relieves the urging of the transfer roll against the ink roll in a manner which regulates the amount of ink that is transferred from the ink roll to the transfer roll. The result is less re-inking in the case of a saturated ribbon condition and more re-inking as the ink is depleted from the ribbon. In this manner and arrangement, it is seen that the re-inking mechanism provides for self-regulation and control of the amount of ink which is transferred from the inking roll to the transfer roll so as to maintain a properly inked ribbon.

And, still an improved re-inking device utilizes a vane-like pivotal member having substantially identical rolls opposed to each other and in pressure contact with the ribbon to be rotated thereby. The pivotal member is a rockable carriage having an ink transfer roll on one arm thereof in pressure engagement with an ink roll and a second roll on the opposite arm for balancing the carriage.

In view of the above discussion, the principal object of the present invention is to provide re-inking mechanism in a ribbon cassette for extending the useful life of the ribbon.

Another object of the present invention is to provide a ribbon cassette with re-inking mechanism contained therein arranged to operate in any orientation thereof.

An additional object of the present invention is to provide a re-inking mechanism wherein the drive force for rotating both the inking and transfer rollers is obtained from travel of the ribbon in contact with the transfer roller.

A further object of the present invention is to provide a ribbon re-inking mechanism wherein an inking roll is fixed and an ink transfer roll is rockable thereagainst for maintaining proper inking of the ribbon.

Still a further object of the present invention is to provide a ribbon cassette with re-inking mechanism wherein the re-inking of the ribbon is self-regulating by pivotally mounting the ink transfer roll relative to the inking roll.

Still another object of the present invention is to provide a ribbon cassette with re-inking mechanism contained therein and including balancing means arranged to enable proper functioning of such mechanism in any orientation of the cassette and movement thereof.

Additional objects and advantages of the present invention will become apparent and fully understood from a reading of the following specification taken together with the annexed drawing.

BRIEF DESCRIPTION OF THE DRAWING

FIG. 4 is a top plan view of the body of a ribbon cassette having the cover removed to show the interior structure;

FIG. 5 is a front elevational view taken along the line 5—5 of FIG. 4;

FIG. 6 is a side elevational view taken along the line 6—6 of FIG. 4;

FIG. 7 is an enlarged elevational view of a portion of the re-inking mechanism shown in FIG. 4;

FIG. 12 is a top plan view of the body of a ribbon cassette having portions of the cover removed to show a modified interior structure;

FIG. 13 is an enlarged plan view of the re-inking mechanism shown in FIG. 12; and FIG. 14 is a side elevational view taken along the line 14—14 of FIG. 13.

DESCRIPTION OF THE PREFERRED EMBODIMENT

Figure 1:
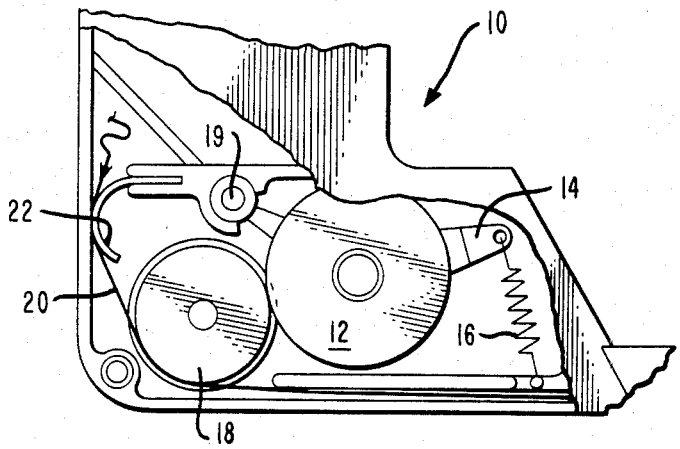
FIG. 1 is a top plan view of a portion of a ribbon cassette illustrating an early design of a ribbon re-inking mechanism.

As briefly mentioned above, the early approaches and efforts to provide a re-inking mechanism in a ribbon cassette or other like support means, designated generally as 10 in FIG. 1, included a porous rubber ink roll 12 which is suitably journaled and mounted on a pivoted carriage 14 and biased or urged by a spring 16 connected at one end thereof to the carriage and at the other end to the cassette. An ink transfer roll 18 is journaled in fixed position or location adjacent the ink roll 12 and a ribbon 20 is caused to be trained or guided around a portion of the periphery of the transfer roll 18. The spring 16 tends to rotate the ink roll 12 in a clockwise direction around a pivot 19 and causes the ink roll to be urged against and to remain in firm surface contact with the transfer roll 18. This early arrangement required a specific level of ribbon tension in order to drive both the transfer roll 18 and the inking roll 12 by means of the ribbon 20 itself, and as a consequence of such required tension level, a tensioner member 22 was provided to form a channel between the tensioner member and a wall of the cassette 10 wherein the ribbon 20 traveled along a precise path prior to being inked by the transfer roll 18. The problems experienced with this early arrangement were the inconsistent drive of the mechanism by the tensioned ribbon 20, the edge wearing of the ribbon by the tensioner member 22, and an orientation problem affecting function of the cassette due to the greater mass of the ink roll 12 as compared with the transfer roll 18.

Figure 2:
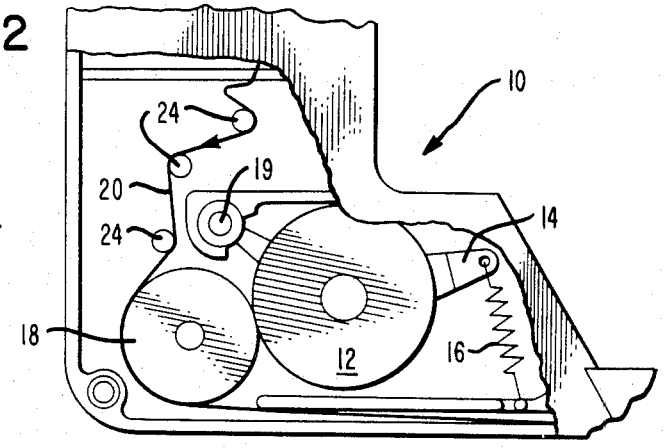
FIG. 2 is a similar view showing a later design of a re-inking mechanism.

A later design is shown in FIG. 2 wherein the ink roll 12 is mounted on the carriage 14 and is biased by the spring 16 to tend to rotate the ink roll around the pivot 19, in similar manner as shown in FIG. 1. A large portion of the periphery of the ink transfer roll 18 is wrapped by the ribbon 20 after traveling a serpentine path around a plurality of guide posts 24. The posts 24 are specifically and precisely positioned relative to the transfer roll 18, to effectively replace the tensioner member 22 in FIG. 1, and to provide for the increase of the ribbon wrap around the portion of the periphery of the transfer roll for the purpose of improving the driving force for such roll and also to provide for an increase in the ribbon tension. However, it was found in this later arrangement that the ribbon tension was extremely high and, as such, created an excessive drive torque.

Figure 3:
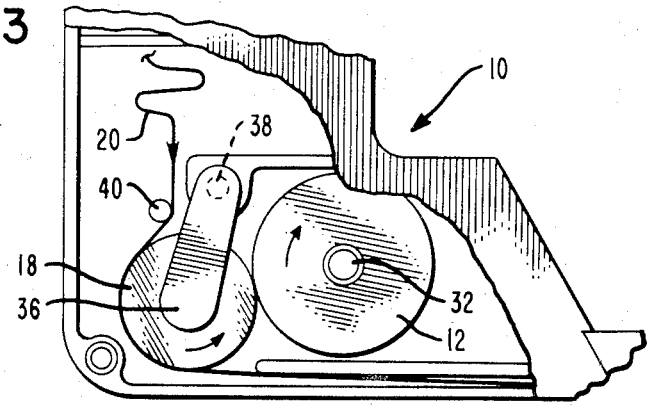
FIG. 3 is a similar view of the ribbon cassette of FIGS. 1 and 2 but illustrating a ribbon re-inking mechanism incorporating the subject matter of the present invention.

Another design resulted in the present invention that provides for an arrangement wherein, as shown in FIG. 3, the cassette 10 provides space for a re-inking mechanism which includes the porous rubber inking roll 12 journaled on a fixed-positioned shaft or spindle 32. The transfer roll 18 is rotatably mounted on and carried by a carriage 36 which is journaled on a pivot or spindle 38 and which roll 18 is normally in surface contact with the inking roll 12. A single guidepost 40 is provided upstream of the transfer roll 18 to cause the ribbon 20 to travel along a path just short of halfway around the periphery of the transfer roll 18.

While the concept of the present invention includes certain elements for practicing same, it is seen that the arrangement of the re-inking mechanism within the cassette 10, as specifically shown in FIG. 3, could be of any one of a number of different forms, depending upon the particular design of the cassette. The arrangement provides for self-regulation of the transfer of ink by mounting the ink transfer roll 18 on a pivotable carriage 36 and using the ribbon 20 itself to provide the tension and drive torque for the ink transfer roll so as to cause such roll to enable and to effect an increase or a decrease in the transfer of ink thereto from the inking roll 12, all in a manner dependent upon the ribbon tension and the resultant pressure of the transfer roll 18 against the inking roll 12.

FIG. 4 is a top plan view of the body of a ribbon cassette having the cover removed therefrom to show the interior structure and the various components thereof in a preferred arrangement of the subject matter of the present invention. Such cassette body 50 is preferably of molded plastic material and takes the shape of a generally rectangular flat case for supporting the ribbon thereof and which is adapted to fit adjacent or along the printing station of a printer. As shown, the cassette body 50 includes a large cavity or chamber 52 formed in part by an outer wall starting at the right side of the cassette and having a wall portion 54 curving toward the rear of the cassette, a wall portion 56 running along the rear of the cassette, and a wall portion 58 curving toward the front of the cassette near the left side thereof. A generally centrally-located wall 60 extends for a distance through the cassette body 50 and a slanted or inclined wall 62 is connected with and is directed from one end of the wall 60 at an angle downwardly and toward the front of the body of the cassette. The wall 62 continues to form a wall portion 64 along the front of the cassette body and toward the right side thereof. A short wall portion 66 and another wall portion 68 are located between the wall portion 64 and the start of the wall portion 54.

A plurality of latch members or lugs 70 are formed as an integral part of the cassette body and are positioned generally at the four corners thereof for connection and attachment to mating receptacles in the cover of the cassette. A front guide or locating finger 72 is provided as an integral part of the cassette body 50 for aid in connecting the cassette cover with such body. It is understood, of course, that the cassette includes the body 50 with the cover (later described) connected to form the enclosure for the ribbon.

The internal components of the body 50 of the cassette include a pair of rollers 80 and 82 which are positioned to cooperate with each other in driving a ribbon 84 at the entrance end of the cassette, in the direction indicated by the arrow 86, and into the cavity or chamber 52. It is, of course, to be noted that, while the ribbon 84 is shown as a single strand within the cavity 52, the ribbon is folded many times in a stuffing manner to substantially fill the cavity. The roller 82 is preferably the drive roller and is connected to a drive member (not shown) while the idler roller 80 is maintained in biased position against such roller 82 by means of a spring 88 wrapped around a stud or pin 90 and having one end thereof engageable against one end of a support arm 92 pivoted on a spindle or a shaft 94. The other end of the spring 88 engages an extension 96 of the wall 62, whereby the arm 92 is thus urged against the idler roller 80 which, in turn, is urged against the drive roller 82 by action of the spring 88 to provide a precise drive for the ribbon 84. As is well known in the art, the support arm 92 may include a plurality of stripper bearings which are positioned to mate with and extend between the several ribbon driving portions of the idler roller 80.

A ribbon re-inking mechanism is provided and supported within the cassette body 50 adjacent the ribbon 84 exit at the right side thereof. A porous rubber inking roll 100 is rotatably carried or journaled on a hub 101 supported from a spindle 102 positioned in a cavity or chamber 104 formed by the walls 60, 62 and 64. An ink transfer roll 110 preferably of plastic material is supported from and carried on a carriage 112 at the right of inking roll 100. The carriage 112 includes a spindle 114 at one end thereof for rotatably carrying the transfer roll 110 and includes a hub 116 at the other end thereof seated on a pivot pin or spindle 118. A roller or like bearing 119 is positioned and journaled on a spindle 120 adjacent the wall portion 54. The carriage 112 with the ink transfer roll 110 thereon is journaled or pivoted on the spindle 118 to enable the transfer roll to surface engage with the inking roll 100 in increasing or decreasing pressure conditions.

The ribbon 84 is contained within the cavity or chamber 52 in a random or stuffing manner and is caused to be pulled across a lower ridge or dam 115 and then directed by a wall portion 122 formed as an end of the wall 60 to take a path around the bearing 119. From such bearing 119, the ribbon 84 is directed around a guidepost 124 and then around the transfer roll 110 with sufficient tension therein to cause rotation of the transfer roll along with rotation of the inking roll 100. The spindle 114 provides a loose fit for ease of rotation of the transfer roll 110. The ribbon 84 is directed past the exit of the cassette body 50 and along the printing station (not shown) and then is positioned between the rollers 80 and 82 to be driven thereby and back into the storage chamber 52. The path of the ribbon is shown along with an indication of the direction of rotation of the several rollers by means of appropriate arrows in FIG. 4.

FIGS. 5 and 6 show elevational views of the body 50 of the cassette wherein the front view (FIG. 5) illustrates a two degree angle of the ribbon path with respect to the line of printing for the purpose of making better use of the ribbon width. The cassette body 50 is formed to provide the entire ribbon path, including that portion of the ribbon 84 in the storage chamber or cavity 52 as well as the portion past the printing station, in a plane at two degrees from the line of printing, all as more specifically described in U.S. Pat. No. 4,209,261. The side view in FIG. 6 also shows the latch member or lugs 70 along with the spindles or hubs for the several rollers. It should be noted that the several spindles, pivot pins, and the like are generally molded as an integral part of the body 50 of the cassette.

FIG. 7 is an enlarged elevational view of a portion of the re-inking mechanism shown in FIG. 4 and better illustrates the carriage 112 which has the upstanding hub 116 journaled on the pivot pin 118, the latter shown as being an integral part of the cassette body 50. The ink transfer roll 110 is freely journaled on the spindle 114 at the other end of the carriage 112 and is caused to be moved in a rockable manner toward and away from the ink roll 100 (FIG. 4) around the pivot pin 118. It must be realized, of course, that the extent of the rockable motion is relatively small as required by the amount of ink on the exterior periphery of the ink transfer roll 110 for re-inking the ribbon 84, by the tension in the ribbon 84 for providing the torque for rotating the transfer roll 110 and also the inking roll 100, for out-of-roundness compensation and self regulation.

Figure 8:
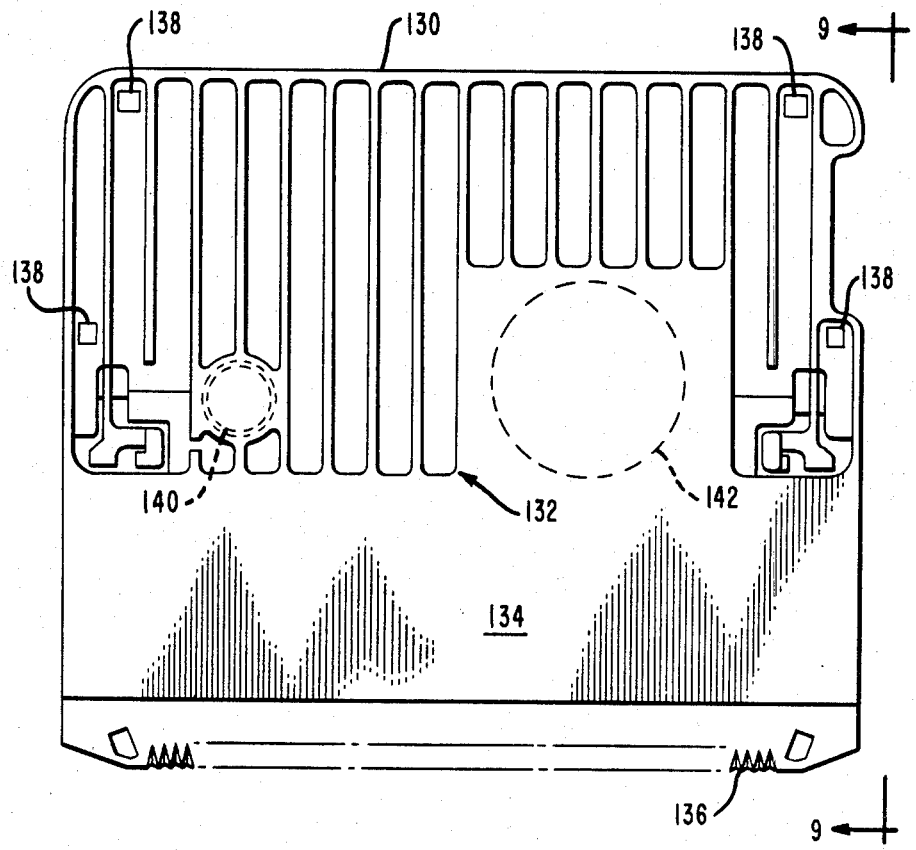
FIG. 8 is a top plan view of the cover of the cassette shown in FIG. 4.

FIG. 8 illustrates the top plan of a cover 130 for the cassette which fits onto the cassette body 50, shown in FIG. 4. The cover 130 has a ribbed portion 132 covering approximately the upper half of the cover and which portion generally matches the outline of the body 50. The ribbed portion 132 provides a design for improved moldability and to present a pleasing appearance across the top of the cover 130 relative to the two degree angle of the configuration of the cassette and of the path taken by the ribbon 84. The front portion 134 of the cover is generally plain and provides space for and covers the printing mechanism which may take the form of print wire solenoids, as more fully described in U.S. Pat. No. 4,209,261. The front portion 134 also includes a tear-off edge 136, and several receptacles 138 are provided in the cover 130 for receiving the lugs 70 (FIG. 4). A recess 140 is provided in the cover 130 for accommodating the ribbon idler roller 80 while a further recess 142 in the cover accommodates the porous inking roll 100. As briefly alluded to earlier herein, the cassette includes the body 50 (FIG. 4) with the cover 130 (FIG. 8) fitting thereon to form the enclosure for the ribbon 84.

Figure 9:
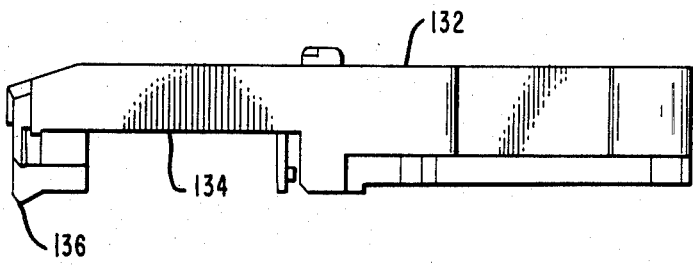
FIG. 9 is a side elevational view taken along the line 9—9 of FIG. 8.

FIG. 9 illustrates the shape of the cassette cover 130 as viewed in the direction from the right side of FIG. 8. The ribbed portion 132 covers the cassette body 50 and the plain portion 134 extends beyond the body to cover generally the printing mechanism (not shown) with which the ribbed cassette is associated.

Figure 10:
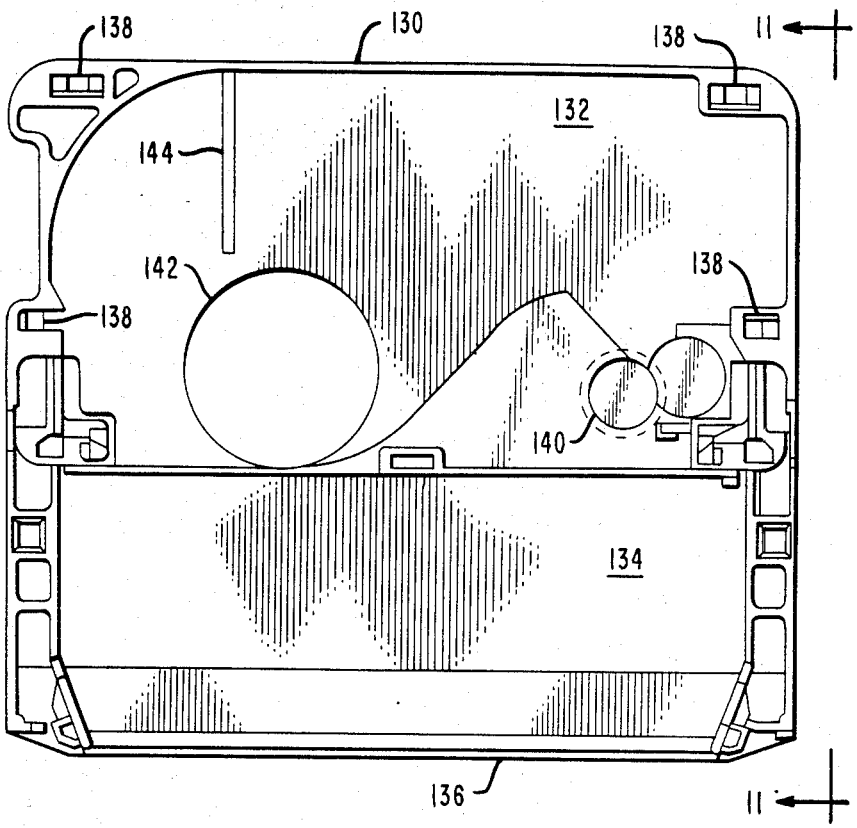
FIG. 10 is a plan view of the underside of the cassette cover shown in FIG. 8.
Figure 11:
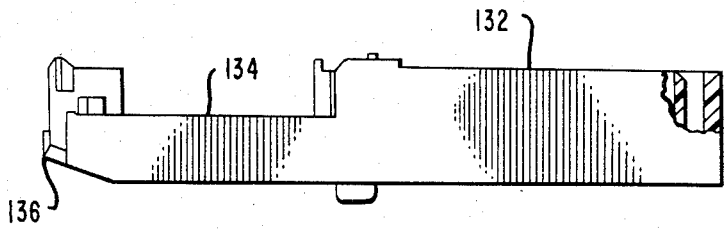
FIG. 11 is a side elevational view taken along the line 11—11 of FIG. 10.

FIG. 10 shows the underside of the cassette cover 130 in an orientation opposite from the top plan view thereof in FIG. 8. The underside of the ribbed portion 132 of the cover 130 also shows the location of an upper ridge or dam 144 for association with the body 50 carried lower ridge or dam 115, of the inking roll recess 142 and of the idler roll recess 140 along with the receptacles 138 for receiving the lugs 70 on the cassette body 50. The frontal portion 134 and the tear-off edges 136 are also shown in the elevational view in FIG. 11 which is viewed from the right side of FIG. 10. In the operation of the ribbon cassette and the re-inking mechanism therein, the ribbon 84, which is preferably one-quarter inch wide and formed in a loop approximately eighteen feet long, is loaded or stuffed into the cavity 52 but with a portion of the loop extending in the path around the roller 19 and around the ink transfer roll 110, along the printing station or line of printing generally in the vicinity of the tear-off edge 136, and then between the idler and drive rollers 80 and 82, which preferably drive the ribbon in continuous manner, and back into the chamber 52.

As the ribbon 84 is being subjected to impact by the printing elements (such as print wires) during the printing operation, the ink in the ribbon is being used or consumed in such operation. As ink is depleted from the ribbon 84, the ribbon is less saturated, or may become dry in a relative sense, and the frictional force between the less saturated ribbon and the ink transfer roll 110 increases along with a corresponding increase in ribbon tension resulting from the pull of the idler and drive rollers 80 and 82 and the increased frictional force. The increased ribbon tension, in turn, cause the ribbon 84 to increase the pressure on or against the ink transfer roll 110 and to push or ease such roll in rockable manner against and in surface contact with inking roll 100 with a greater force to effect an increased transfer of ink to the transfer roll and therefrom to the ribbon.

As the ribbon 84 becomes more saturated with an increased transfer of ink thereto, the ribbon tension decreases in relative terms by reason of the ink saturated or wet condition since, in effect, such ribbon does not have as much frictional force in rotating the ink transfer roll 110. The effect of decreased ribbon tension and decreased frictional force reduces the amount or rate of ink transfer from the inking roll 100 to the transfer roll 110 by reason of the transfer roll 110 rocking or easing away from the inking roll 100. It is seen that a lesser amount of ink is transferred or lesser re-inking is necessary when the ribbon is relatively saturated and that a greater amount of ink is transferred or more re-inking is required when ink becomes depleted from the ribbon or when the ribbon is relatively less saturated. In this manner of operation, the re-inking process is self-regulating and, in effect, automatically re-inks the ribbon, dependent upon the ink saturated condition thereof.

FIG. 12 illustrates a modified ribbon cassette 150 having a body 152 with portions of the cover removed to show ribbon drive means and ribbon re-inking mechanism. The cassette body 152 is preferably of molded plastic and takes the shape of a generally rectangular flat case for supporting the ribbon thereof and which includes a nose portion 154 adapted to fit on and move with a print head (not shown) which is caused to be moved in side-to-side direction along the printing station of the printer.

A ribbon 156, preferably of the endless type, is caused to be driven by a drive roller 158 shown in the upper right corner of FIG. 12, which drive roller is opposed by a spring 160 urged idler roller 162. The operation of drive roller 158 and idler roller 162 is similar to that as described for the above-mentioned rollers in FIG. 4.

The ribbon 156 is caused to follow a path and to be trained from a large chamber or cavity within the body 152 of the cassette 150 past a re-inking mechanism 164 in the lower left hand corner therof. FIG. 13 shows an enlarged view of the re-inking mechanism 164 and FIG. 14 is a side view of the mechanism. The ribbon 156 is trained around a guide post 166, engages with a balancing roll 168, is trained around a carriage post 170 on a cassette pivot or pin 172, and engages with an ink transfer roll 174 and with a guide roll 175 prior to passing the nose portion 154 of the cassette. A porous rubber inking roll 176 is rotatably carried or journaled on a hub 178 supported in a cavity of the cassette. The ink transfer roll 174, the roller 170 and the balancing roll 168 are supported from and carried on a carriage 180 (FIG. 14) pivoted on the pin 172. The balancing roll 168 is journaled on a pin 182 and the ink transfer roll is journaled on a pin 184. The pin 172 is shown as an integral part of the base 186 of the cassette 152. A cover 188 is provided to enclose the ribbon 156 and the various operating parts of the cassette 150.

In the operation of the re-inking mechanism 164 as illustrated in FIGS. 12, 13 and 14, the ribbon 156 is pulled from the stuffing box or cavity within the body 152 of the cassette 150, past the guide post 166, around the balancing roll 168, past the carriage post 170, and around the ink transfer roll 174, all in an attitude dependent upon the amount of ink on the ribbon. As ink is depleted from the ribbon 156 and becomes dry in a relative sense, the frictional force between the less saturated ribbon and the ink transfer roll increases along with a corresponding increase in ribbon tension resulting from the pull of the drive and idler rollers 158 and 162 and the increased frictional force. The increased ribbon tension, in turn, causes the ribbon 156 to increase the pressure on or against the balance roll 168 and on or against the ink transfer roll 174 and to push or ease such roll 174 in counterclockwise rotational manner around pivot 172 and against and in surface contact with the inking roll 176 with a greater force to effect an increased transfer of ink from the inking roll to the transfer roll and therefrom to the ribbon.

As the ribbon 156 becomes more saturated with an increased transfer of ink thereto, the ribbon tension decreases in relative terms by reason of the ink saturated or wet condition since, in effect, such ribbon does not have as much frictional force in rotating the ink transfer roll 174. The effect of decreased ribbon tension and decreased frictional force reduces the amount or rate of ink transfer from the inking roll 176 to the transfer roll 174 by reason of the transfer roll moving or easing away in clockwise rotational manner around pivot post 172 from the inking roll 176. It is seen that a lesser amount of ink is transferred or lesser re-inking is necessary when the ribbon is relatively saturated and that a greater amount of ink is transferred or more re-inking is required when ink becomes depleted from the ribbon or when the ribbon is relatively less saturated. In this manner of operation, the re-inking process is self-regulating and, in effect, automatically re-inks the ribbon, dependent upon the ink saturated or unsaturated condition or attitude thereof. Additionally, the balancing roll 168, being identical to the ink transfer roll 174, provides an equal and opposite force thereto by reason of such rolls being carried on the common carriage 180 journaled on the pivot pin 172. The equal and opposite roll construction enables proper operation of the re-inking mechanism regardless of orientation of the ribbon cassette 150 or of movement thereof in side-to-side direction, and also adds re-inking sensitivity to the operation.

It is thus seen that herein shown and described is a ribbon cassette having a re-inking mechanism therein which utilizes increased and decreased tension in the ribbon itself to effect an increase and a decrease in the pressure of an ink transfer roll bearing against an inking roll in the manner of rocking or oscillating motion of the ink transfer roll relative to the stationary inking roll. A balancing roll is provided for the ink transfer roll so as to enable proper operation of the re-inking mechanism in different orientations and movement of the ribbon cassette and for increased sensitivity of the reinking function. The mechanism of the present invention enables the accomplishment of the objects and advantages mentioned above, and while a preferred embodiment and a modification have been disclosed herein, other variations thereof may occur to those skilled in the art. It is contemplated that all such variations not departing from the spirit and scope of the invention hereof are to be construed in accordance with the following claims.

We claim:

1. Self-regulating ribbon reinking means in a cassette including an enclosure having a body and a cover therefor, and an endless ribbon within said enclosure, said ribbon re-inking means comprising means for driving said ribbon for use in printing operations, an ink supply roll rotatably supported from said body at a fixed location within the enclosure, and ink transfer means comprising pivot means integral with said cassette body, a carriage comprising a rigid bar, said bar being pivotally mounted at substantially its midpoint on the pivot means, a transfer roll and a balancing roll of substantially identical structure, said balancing and transfer rolls being mounted within the enclosure on opposite ends of said bar, said transfer roll engaging said ink supply roll and serving to transfer ink from said ink supply roll to said ribbon, said ribbon being trained about said transfer and balancing rolls such that tension in said ribbon creates forces acting on said balancing and transfer rolls, the force acting on said balancing roll tending to rotate the carriage in the same sense as the force acting on said transfer roll, said forces created by the tension in said ribbon being substantially the only forces acting to rotate the carriage, a decrease of ink in said ribbon increasing said forces and thus causing said carriage to rotate in a first rotational direction, thereby increasing the contact pressure between the transfer roll and the ink supply roll so that an increased volume of ink flows from said ink supply roll to said transfer roll, and an increase of ink in said ribbon decreasing said forces and causing said carriage to rotate in a second direction, opposite to said first direction, thus decreasing the contact pressure between said transfer roll and said ink supply roll so that a decrease volume of ink flows from said ink supply roll to said transfer roll.

2. The subject matter of claim 1 wherein said means for driving said ribbon comprise a pair of opposed rollers.

3. The subject matter of claim 1 wherein said ink transfer roll is rockably supported adjacent the ink supply roll and is opposed to rockable movement by said balancing roll.

4. The subject matter of claim 1 including guide means for directing said ribbon in a path to provide sufficient contact with said balancing roll and with said transfer roll for rotational driving thereof.

* * * * *